US008181693B2

(12) United States Patent
Park et al.

(10) Patent No.: US 8,181,693 B2
(45) Date of Patent: May 22, 2012

(54) SELF-CLEANING HEAT EXCHANGER USING SYSTEM FOR SUPPLYING SOLID PARTICLE AND WATER

(75) Inventors: Sang-Il Park, Yuseong-Gu (KR); Kyong-Bin Choi, Yuseong-Gu (KR); Chang-Bok Ko, Yuseong-Gu (KR)

(73) Assignee: Korea Institute of Energy Research, Daejeon (KR)

( * ) Notice: Subject to any disclaimer, the term of this patent is extended or adjusted under 35 U.S.C. 154(b) by 896 days.

(21) Appl. No.: 12/282,307

(22) PCT Filed: Nov. 29, 2006

(86) PCT No.: PCT/KR2006/005075

§ 371 (c)(1), (2), (4) Date: Sep. 9, 2008

(87) PCT Pub. No.: WO2008/060004

PCT Pub. Date: May 22, 2008

(65) Prior Publication Data

US 2009/0095445 A1 Apr. 16, 2009

(30) Foreign Application Priority Data

Nov. 17, 2006 (KR) ..... 10-2006-0113735

(51) Int. Cl.
*F28G 1/12* (2006.01)
*F24B 13/00* (2006.01)

(52) U.S. Cl. ..... 165/95; 165/303; 15/3.51

(58) Field of Classification Search ..... 165/95, 165/303, 157; 15/3.51, 104.061, 104.05, 15/3.5, 21.2; *F28G 1/12*

See application file for complete search history.

(56) References Cited

U.S. PATENT DOCUMENTS

| | | | | |
|---|---|---|---|---|
| 1,795,348 | A * | 3/1931 | Schmidt | 165/95 |
| 3,215,195 | A * | 11/1965 | Treplin | 165/95 |
| 4,420,038 | A * | 12/1983 | Okouchi et al. | 165/95 |
| 6,609,559 | B2 | 8/2003 | Jackson | |
| 7,055,580 | B2 * | 6/2006 | Schildmann et al. | 165/95 |

FOREIGN PATENT DOCUMENTS

JP 54121453 A * 9/1979

(Continued)

OTHER PUBLICATIONS

Machine English translation of KR 20-0398579 Y1, Aug. 2011.*

(Continued)

*Primary Examiner* — Tho V Duong
(74) *Attorney, Agent, or Firm* — Arent Fox LLP

(57) ABSTRACT

A self-cleaning, shell and tube type heat exchanger using a solid particle-water supply system. The heat exchanger includes solid particle supplying means for storing and supplying solid particles to be used in cleaning the heat exchanger tubes, and water supply means for fluidizing the solid particles stored in the solid particle supplying means so as to supply the solid particles into a mixed fluid discharging means, or for directly supplying water to the mixed fluid discharging means. The mixed fluid discharging means sucks the supplied solid particles and water, and sprays the supplied solid particles and water as a mixed fluid from above the vertical heat transfer tube arrangement such that inside surface of the heat transfer tubes can be cleaned. Separating means separates the mixed fluid used in cleaning the heat transfer tubes into solid particles and water, using a gravitational separation method.

10 Claims, 1 Drawing Sheet

FOREIGN PATENT DOCUMENTS

| | | | | |
|---|---|---|---|---|
| JP | 58-119090 | U | | 8/1983 |
| JP | 58119090 | U | * | 8/1983 |
| JP | 59164897 | A | * | 9/1984 |
| KR | 10-0124929 | B1 | | 12/1997 |
| KR | 100124929 | B1 | * | 12/1997 |
| KR | 10-0355706 | B1 | | 12/2002 |
| KR | 100355706 | B1 | * | 12/2002 |
| KR | 2003064364 | A | * | 7/2003 |
| KR | 2003086155 | A | * | 11/2003 |
| KR | 20-0398579 | Y1 | | 10/2005 |
| KR | 2003098579 | Y1 | * | 10/2005 |

OTHER PUBLICATIONS

Machine English translation of KR 10-0355706B1, Aug. 2011.*
Machine English translation of KR 10-0124929B1, Aug. 2011.*

* cited by examiner

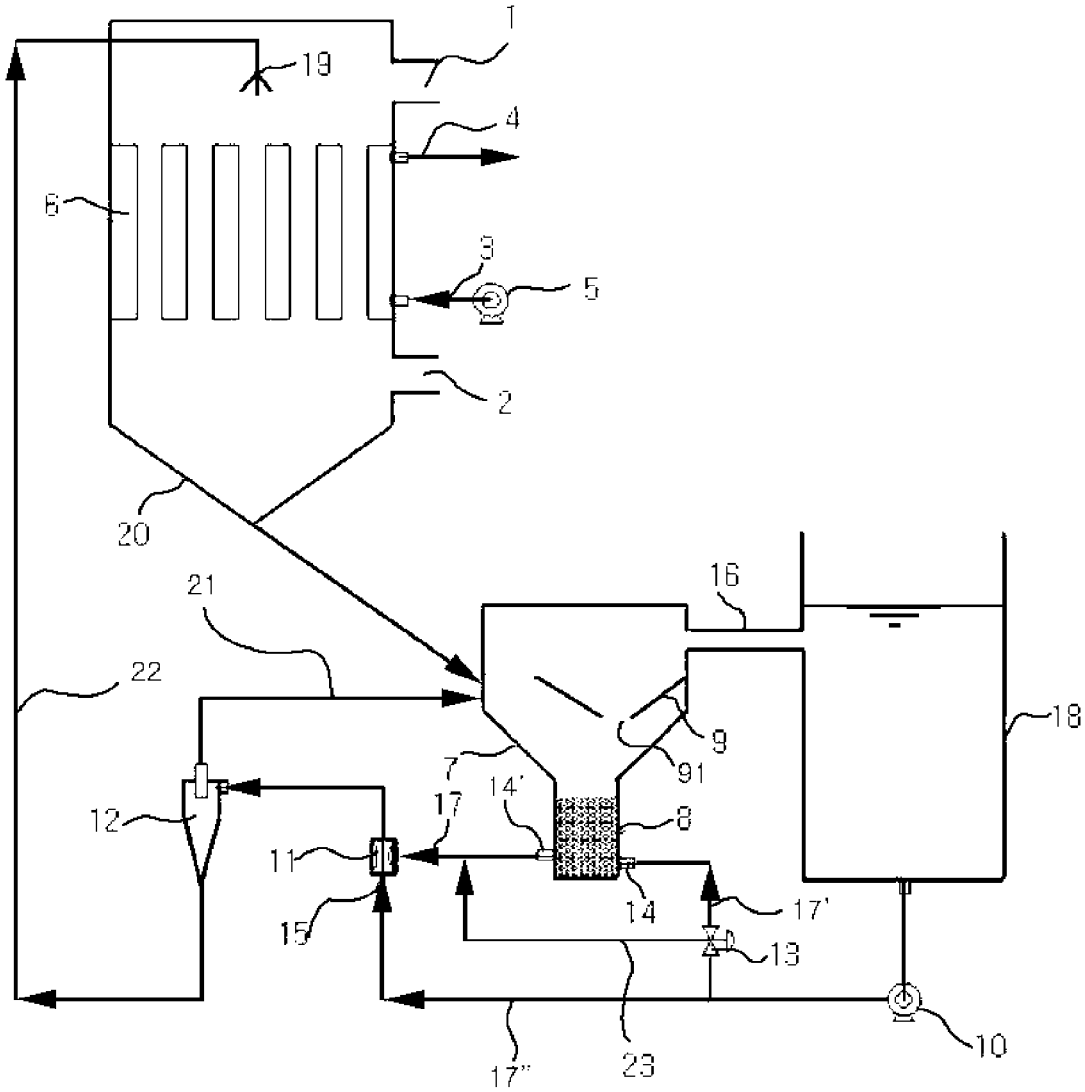
1
19
4
6
3
5
2
20
21
16
22
18
9
91
7
14'
17
8
12
11
14
17'
15
13
10
17''
23

SELF-CLEANING HEAT EXCHANGER USING SYSTEM FOR SUPPLYING SOLID PARTICLE AND WATER

TECHNICAL FIELD

The present invention relates to a self-cleaning heat exchanger using a solid particle-water supply system, particularly, to a self-cleaning heat exchanger for reducing the fouling of heat transfer surfaces thereof, which generally occurs when the heat exchanger is used to recover waste heat from exhaust gas, which is discharged from an industrial furnace or the like in industrial facilities, and which contains fouling materials at high temperatures, and more particularly, to a shell and tube type heat exchanger having vertical heat transfer tubes, in which, when the fouling materials have accumulated on the inside of the heat transfer tubes as the high-temperature exhaust gas passes through the inside of the heat transfer tubes of the heat exchanger, a mixed fluid of solid particles and water can be sprayed from an upper portion of the heat exchanger and flow down along the inside surface of the heat transfer tubes in order to clean the walls of the heat transfer tubes.

BACKGROUND ART

A Fagersta economizer, made in Sweden, is a shell and tube type heat exchanger having vertical heat transfer tubes for recovering low-temperature waste heat from the exhaust gas of a heavy oil-fired boiler, in which the heat exchanger can recover not only sensible heat of the exhaust gas but also latent heat of condensation contained in the water vapor. Such a heat exchanger has, as a cleaning system, a structure enabling water to be sprayed onto the upper portion of the heat exchanger in order to clean the heat exchanger.

However, if combustion in the boiler is not efficient, water vapor, acid gases and so on within the exhaust gas can be condensed to heat transfer surfaces such that the heat transfer surfaces remain in a wetted state, thereby promoting the adhesion of the dust in the exhaust gas to the heat transfer surfaces. In addition, the dust has stickiness and a tendency to solidify as time passes. Therefore, if such a situation persists, there is a problem in that the cleaning effect achieved by spraying water may be poor, and hence, the heat transfer tubes may be clogged due to the adhesion of fouling materials thereon.

Furthermore, heat transfer tubes coated with Teflon are used in some heat exchangers. Because the surface of Teflon is smooth, the dust does not readily adhere and can be easily cleaned away using water. However, once the dust in the exhaust gas has adhered and solidified on the heat transfer surfaces, there is a problem in that it is difficult to completely clean the fouled heat transfer tubes with a simple water cleaning process.

As an approach to overcome such problems, the Korea Institute of Energy Research has recovered waste heat from exhaust gas using a construction in which a perforated plate is installed in a flow path for exhaust gas of a dryer and a bundle of heat transfer tubes coated with Teflon is placed above the perforated plate. Because sticky dust is contained in the exhaust gas of the dryer, the dust adheres to the heat transfer surface and the adhered dust is gradually solidified. In order to clean the heat exchanger for recovering waste heat from the exhaust gas of the dryer, the heat transfer surfaces have to be cleaned by supplying water on the perforated plate for a given time period and forming a water fluidized bed within the array of heat transfer tubes.

However, it has been found that there the ability to clean the heat transfer surfaces using the water fluidized bed is limited after the fouling materials adhering to the heat transfer surfaces have been solidified.

Thus, in the case of the heat transfer tubes to which the fouled materials are solidified, after stopping operating of the heat exchanger, workers directly insert a high pressure cleaner into the heat transfer tubes, and clean the heat transfer tubes by spraying water onto the wall surfaces thereof at high pressure.

However, in the case as mentioned above, there are problems in that the maintenance costs is increased, the heat exchanger and the related process have to be stopped, and thus the productivity of the entire process suffers.

In addition, in another method, a cleaning process comprises dropping shot balls down into the heat transfer tubes.

Unfortunately, such a method has a problem that when the shot balls are dropped down, the heat transfer surfaces become damaged by the fast downward speed of the shot balls, and the contact efficiency between the vertical heat transfer surfaces and the shot balls is very low.

Further more, the method as mentioned above has another problem in that an apparatus such as a bucket elevator has to be used to deliver the shot balls, but such an apparatus is bulky and may lower overall economic efficiency.

DISCLOSURE OF INVENTION

Technical Problem

In order to solve the problems mentioned above, it is an object of the present invention to provide a self-cleaning heat exchanger, including those of a shell and tube type, which can spray a mixed fluid of solid particles and water from above an array of vertical heat transfer tubes of the heat exchanger and thereby supply the mixed fluid of solid particles and water into the inside of the vertical heat transfer tubes so that it flows down along heat transfer surfaces of the heat exchanger, thereby decreasing damage to the heat transfer surfaces while increasing contact efficiency between the solid particles and the heat transfer surfaces such that cleaning efficiency of the heat transfer surfaces can be remarkably enhanced.

Technical Solution

To achieve the above object and achieve the goal of eliminating the problems with the related art, the invention provides a shell and tube type heat exchanger having a plurality of arrayed vertical heat transfer tubes, wherein high-temperature exhaust gas containing fouling materials flows into an exhaust gas inlet, that is, an inflow port, at an upper portion of the heat exchanger and is then cooled while flowing down along the inside of the heat transfer tubes, and finally the resultant cooled exhaust gas is discharged through an exhaust gas outlet as an outflow port at the lower portion of the heat exchanger main body. The heat exchanger includes solid particle supplying means for storing and supplying solid particles to be used in cleaning the heat exchanger tubes; water supply means for fluidizing the solid particles stored in the solid particle supplying means so as to supply the solid particles to a mixed fluid discharging means, or for directly supplying water to the mixed fluid discharging means; the mixed fluid discharging means for sucking the supplied solid particles and water, and for spraying the supplied solid particles and water as a mixed fluid from above the heat transfer tubes such that the heat transfer tubes can be cleaned; and separating means for separating the mixed fluid used in cleaning the heat transfer tubes into solid particles and water, using gravitational separation method.

Preferably, the solid particle supplying means include a mixed fluid tank supplied and stored with the mixed fluid used in cleaning the heat transfer tubes of the heat exchanger main body; and a solid particle tank provided at the lower portion of the mixed fluid tank so as to store the solid particles, wherein the solid particle tank has at one side thereof a fluidizing water outlet connected with an ejector of the mixed fluid discharging means and, at the other side thereof, a fluidizing water inlet supplied with water from the water supplying means.

Preferably, the water supplying means includes a water tank for storing water, the water tank being connected on one side thereof with the mixed fluid tank; and a water pump for supplying the water in the water tank to the solid particle supplying means and the mixed fluid discharging means through a connecting tube.

Preferably, the mixed fluid discharging means comprises an ejector connected both to the solid particle tank and to the water tank; and a mixed fluid nozzle connected to the ejector through a connecting tube so as to spray the mixed fluid to the upper portion of the heat exchanger main body.

Preferably, the solid particle tank is formed to have a vertical cylindrical structure.

Preferably, the water supplying means and the solid particle supplying means are connected with each other through a water tank-solid particle tank connecting tube branching from a water tank-ejector connecting tube, the solid particle supplying means and the mixed fluid discharging means are connected with each other through a solid particle tank-ejector connecting tube, and the water supplying means and the mixed fluid discharging means are connected with each other through the water tank-ejector connecting tube.

Preferably, an automatic control valve is provided at an intermediate position on the water tank-solid particle tank connecting tube, and a connecting tube branching from the automatic control valve is adapted to be connected at any one point along the solid particle tank-ejector connecting tube, such that the flow path of water being supplied to the solid particle tank can be controlled.

Preferably, a hydrocone is further provided at any one point along the connecting tube connecting the mixed fluid nozzle with the ejector, such that some of the water in the mixed fluid can be separated and sent back to the mixed fluid tank through a connecting tube, and hence the mixed fluid is supplied to the mixed fluid nozzle at the upper portion of the heat exchanger main body in a state in which the volume ratio of the solid particles in the mixed fluid is increased.

Preferably, the separating means include a separating plate installed on side of the mixed fluid tank-water tank connecting tube within the mixed fluid tank, and the separating plate is formed with an opening at the lower portion thereof to allow the solid particles to be discharged to the solid particle tank along an inclined surface of the separating plate by gravity.

ADVANTAGEOUS EFFECTS

The invention as mentioned above is a useful invention that is expected to be widely used in industrial facilities, having advantages as follow:

Because the mixed fluid of solid particles and water is used, the heat exchanger can itself clean fouling materials adhering to heat transfer surfaces at the exhaust gas side of the heat transfer tubes of the heat exchanger main body, which are otherwise difficult to remove.

Also, when water is supplied to the ejector after fluidizing the solid particles in the solid particle tank, the ejector can suck the solid particles and water in the solid particle tank connected therewith, and the resultant mixed fluid can be supplied to the hydrocone such that some of the water can be separated therefrom and then sprayed through the nozzle at the upper portion of the heat exchanger. In addition, the volume ratio of the solid particles is increased.

Furthermore, because water can be selectively supplied to the intermediate portion of the solid particle tank-ejector connecting tube, the supply of the mixed fluid or of only water to the heat exchanger is adjustable, and hence the mixed fluid can be first supplied to the heat exchanger main body so as to carry out cleaning with the mixed fluid having high cleaning efficiency, and then water alone can be supplied such that the heat exchanger can be cleaned and at the same time the remained solid particles can be removed from the inside of the vertical heat transfer tubes of the heat exchanger main body and the tubing for the mixed fluid in order to allow the mixed fluid to be readily supplied next time.

Furthermore, even if water is contaminated by impurities in the heat exchanger main body after cleaning the heat exchanger main body, the separating plate for the solid particles using gravitational separation method has a reliable separating effect because the diameter of the solid particles is up to a few mm, and hence a contaminated water supply may be used.

BRIEF DESCRIPTION OF THE DRAWINGS

FIG. 1 is a conceptual view showing a self-cleaning heat exchanger using a solid particle-water supply system.

BEST MODE FOR CARRYING OUT THE INVENTION

Hereinafter, the constitution and the operation thereof according to embodiments of the present invention will be described in detail in conjunction with the accompanying drawings.

FIG. 1 is a conceptual view showing a self-cleaning heat exchanger using a solid particle-water supply system, in which the arrangement, of the invention, shown therein, is constituted by a shell-and-tube-type heat exchanger main body having vertical heat transfer tubes together with apparatuses for storing, delivering and supplying mixed fluid consisting of solid particles and water.

More specifically, high-temperature exhaust gas containing fouling materials flows into an inflow port or an exhaust gas inlet 1 at an upper portion of the heat exchanger and then is cooled while flowing down along the inside of a plurality of arrayed heat transfer tubes 6, and the cooled exhaust gas is discharged through an exhaust gas outlet 2 as an outflow port at the lower portion of the heat exchanger main body 20.

The heat exchanger main body 20 has a mixed fluid tank 7 installed at a lower portion thereof for storing solid particles and water.

The mixed fluid tank 7 has a separating plate 9 installed at an intermediate position thereof. The side surface of the mixed fluid tank 7 above the separating plate 9 is connected with a water tank 18 through a connecting tube 16 for connecting the mixed fluid tank 7 and the water tank 18.

The water in the water tank 18 is sucked by a water pump 10, flowing through a predetermined section of a water tank-ejector connecting tube 17" and flowing into a fluidizing water-supply inlet 14 of a solid particle tank 8 through a connecting tube 17' connecting the water tank 18 with the solid particle tank 8, branching from the water tank-ejector connecting tube 17", thereby fluidizing solid particles in the solid particle tank 8. The fluidized solid particles are then discharged through a fluidizing water outlet 14' formed on the other side of the solid particle tank 8, feeding the ejector 11 through a solid particle tank-ejector connecting tube 17.

In addition, the water in the water tank 18 is supplied to the ejector 11 after passing through the water pump 10, and hence the water and solid particles fluidized within the solid particle tank 8 are simultaneously sucked by the ejector 11 so as to be fed to a hydrocone 12 together with the water supplied to the ejector 11 through the water pump 10.

After the mixed fluid passed through the ejector 11 flows into the hydrocone 12, part of the water is separated and sent back to the mixed fluid tank 7, and the remainder of the water and solid particles is supplied to a mixed fluid nozzle 19 at the upper end of the heat exchanger.

The water containing the solid particles, which has sprayed from the mixed fluid nozzle 19 at the upper portion of the heat exchanger main body 20, flows down along heat transfer surfaces inside the vertical heat transfer tubes 6, thereby removing fouling materials adhered to the heat transfer surfaces. In this procedure, the solid particles, the fouling materials and the water can in turn flow down to the lower portion of the heat exchanger main body 20 so as to flow into the mixed fluid tank 7.

Some of the solid particles in the mixed fluid, flowing into the mixed fluid tank 7 from the heat exchanger in the manner described above, can descend below the separating plate 9 by gravity as to flow into the solid particle tank 8.

In addition, some of the solid particles and water can flow toward the upper side of the separating plate 9, and the solid particles, among others, can settle down on the upper surface of the separating plate 9 by gravity and flow down along the inclined upper surface of the separating plate 9 so as to flow into the solid particle tank 8 through an opening 91 at the lower portion of the separating plate 9.

Therefore, the separating plate 9 can serve as a gravitational settling apparatus such that the solid particles can be separated by gravity so as to descend below the separating plate, so that only water is supplied to the water tank, thereby preventing the solid particles from flowing into the water tank 18 and allowing only water to flow into the water tank 18.

When an automatic control valve 13 is opened in order to supply water to the intermediate portion of the solid particle tank-ejector connecting tube 17, which is a tube for connecting the solid particle tank 8 with the ejector 11, the flow path of water being supplied through the water tank-solid particle connecting tube 17' is changed such that the solid particles in the solid particle tank 8 can be prevented from flowing into the ejector 11. Therefore, the ejector 11 can be supplied with water alone, and in turn, only water is sprayed from the nozzle 19 at the upper portion of the heat exchanger.

As a result, the nozzle 19 can be adjusted so as to spray the mixed fluid when the automatic control valve 13 is closed and to spray water when the automatic control valve 13 is opened.

The following description will be made of the operation of the invention constituted as mentioned above.

The solid particles are loaded into the solid particle tank 8, and then the water passed through the water tank-solid particle tank connecting tube 17' is supplied in the solid particle tank 8 through the fluidizing water inlet 14, and as a result, the solid particles in the solid particle tank 8 are fluidized.

In such a state, when water is supplied to an ejector water inlet 15, which is a portion for supplying water to the ejector 11, the ejector 11 can suck a mixed fluid consisting of solid particles delivered through the solid particle tank-ejector connecting tube 17, and the water delivered from the water tank 18 through the water tank-ejector connecting tube 17", and then can supply the mixed fluid to the mixed fluid nozzle 19 at the upper portion of the heat exchanger main body 20.

Describing more specifically the path of delivering the mixed fluid to the mixed fluid nozzle 19 at the upper portion of the heat exchanger main body 20, some of the water in the mixed fluid can be separated by the hydrocone 12, installed downstream of the ejector 11, so as to be sent back to the mixed fluid tank 7, and the remaining water allows the mixed fluid to be supplied to the mixed fluid nozzle 19 at the upper portion of the heat exchanger main body 20 in a state in which the volume ratio of the solid particles in the mixed fluid is increased.

The mixed fluid of the solid particles and water sprayed from above the vertical heat transfer tubes 6, which are arrayed and installed in the heat exchanger main body 20, can clean fouling materials from the heat transfer surfaces of the heat transfer tubes 6 while flowing down along the inner surface of the heat transfer tubes 6. Then, the mixed fluid passed through the heat exchanger main body 20 can be again supplied though a connecting tube to the mixed fluid tank 7 located below the heat exchanger main body 20.

Some of the solid particles in the mixed fluid supplied from the heat exchanger main body 20 to the mixed fluid tank 7 can descend below the separating plate 9 by gravity, and the remaining solid particles together with water can flow onto the upper portion of the separating plate 9.

While such a mixed fluid is moving toward the water tank 18 through the upper portion of the separating plate 9 and the communicating mixed fluid tank-water tank connecting tube 16, all of the solid particles settle down onto the upper surface of the separating plate 9 by gravity, because the diameter of the solid particles is as large as a few mm, and the solid particles settled down on the upper surface of the separating plate 9 can descend down to the lower portion of the separating plate 9, and can, in turn, be discharged through the opening 91 at the lower portion of the separating plate 9 to the solid particle tank 8 below.

Therefore, the separating plate 9 serves as a kind of gravitational settling separation apparatus. Such a separating plate 9 can maintain its performance as a separating apparatus even if water is somewhat contaminated by impurities.

Consequently, the water tank 18, communicating with the upper portion of the separating plate 9 in the mixed fluid tank 7, can be supplied with water alone in the mixed fluid, and the water in the water tank 18 can be sucked by the water pump 10 so as to be supplied to the ejector 11 and the solid particle tank 8.

Also, when the automatic control valve 13 is opened in order to supply water to the intermediate portion of the solid particle tank-ejector connecting tube 17, which connects the solid particle tank 8 with the ejector 11, the water can be supplied through a connecting tube 23, and the solid particles in the solid particle tank 8 can be prevented from being supplied to the ejector 11.

Therefore, when the flow of water supplied to the intermediate portion of the solid particle tank-ejector connecting tube 17, which connects the solid particle tank 8 with the ejector 11, is freed and blocked using the automatic vale 13, the inflow of the solid particles from the solid particle tank 11 can be controlled, and, as a result, a mixed fluid or only water can be selectively supplied from the ejector 11 to the heat exchanger main body 20 using the automatic control valve 13.

Consequently, the mixed fluid is first supplied to the heat exchanger main body 20 so as to carry out cleaning, and after the supply of the mixed fluid is stopped, only water is supplied such that the remained solid particles can be removed from the inside of the vertical heat transfer tube 6 of the heat exchanger main body 20 and the tubing for the mixed fluid in order to allow the smooth supply of the mixed fluid at the beginning of the next cleaning operation.

The invention is not limited to specific preferred embodiments as mentioned above, but many alterations and variations may be made by those skilled in the art without departing from the spirit of the invention defined in the appended claims. Of course, such alternatives and variations fall within the scope of the appended claims.

The invention claimed is:

1. A self-cleaning heat exchanger using a solid particle-water supply system, the heat exchanger being a shell and tube type having a plurality of arrayed vertical heat transfer tubes, wherein high-temperature exhaust gas containing fouling materials flows into an exhaust gas inlet, as an inflow port, at an upper portion of the heat exchanger, and is then cooled while flowing down along the inside of the heat transfer tubes so that the resultant cooled exhaust gas is discharged through an exhaust gas outlet as an outflow port at the lower portion of the heat exchanger main body, the heat exchanger comprising:

solid particle supplying means for storing and supplying solid particles to be used in cleaning the heat exchanger tubes;

water supply means for fluidizing the solid particles stored in the solid particle supplying means so as to supply the solid particles into mixed fluid discharging means, or for directly supplying water to the mixed fluid discharging means;

the mixed fluid discharging means for sucking the supplied solid particles and water, and for spraying the supplied solid particles and water as a mixed fluid from above the heat transfer tubes such that the heat transfer tubes are cleaned; and separating means for separating the mixed fluid used in cleaning the heat transfer tubes into solid particles and water, using gravitational separation method, wherein the solid particle supplying means comprises a mixed fluid tank supplied and stored with the mixed fluid used in cleaning the heat transfer tubes of the heat exchanger main body, wherein the water supplying means comprises:

a water tank separated from the mixed fluid tank for storing water, the water tank being connected on one side thereof with the mixed fluid tank via a mixed fluid tank-water tank connecting tube such that water separated from the mixed fluid used in cleaning the heat transfer tubes can be supplied and stored therein.

2. The self cleaning heat exchanger using a solid particle-water supply system according to claim 1, wherein the solid particle supplying means comprises:

a solid particle tank provided at the lower portion of the mixed fluid tank so as to store the solid particles, wherein the solid particle tank has at one side thereof a fluidizing water outlet connected with an ejector of the mixed fluid discharging means and at the other side a fluidizing water inlet supplied with water from the water supplying means.

3. The self cleaning heat exchanger using a solid particle-water supply system according to claim 1, wherein the water supplying means comprises:

a water pump for supplying the water in the water tank to the solid particle supplying means and the mixed fluid discharging means.

4. The self cleaning heat exchanger using a solid particle-water supply system according to claim 2, wherein the mixed fluid discharging means comprises:

an ejector connected with the solid particle tank and with the water tank; and a mixed fluid nozzle connected with the ejector through a connecting tube so as to spray the mixed fluid to the upper portion of the heat exchanger main body.

5. The self cleaning heat exchanger using a solid particle-water supply system according to claim 1, wherein the solid particle supplying means comprises:

a solid particle tank provided at the lower portion of the mixed fluid tank so as to store the solid particles, wherein the solid particle tank has on one side thereof a fluidizing water outlet connected with an ejector of the mixed fluid discharging means and on the other side a fluidizing water inlet supplied with water from the water supplying means, wherein the mixed fluid discharging means comprises:

an ejector connected with the solid particle tank and with the water tank; and a mixed fluid nozzle connected with the ejector through a connecting tube so as to spray the mixed fluid to the upper portion of the heat exchanger main body.

6. The self cleaning heat exchanger using a solid particle-water supply system according to claim 2 or 5, wherein the solid particle tank is formed to have a vertical cylindrical structure.

7. The self cleaning heat exchanger using a solid particle-water supply system according to any one of the preceding claims 1 to 5, wherein the water supplying means and the solid particle supplying means are connected with each other through the water tank-solid particle tank connecting tube branching from a water tank-ejector connecting tube, wherein the solid particle supplying means and the mixed fluid discharging means are connected with each other through a solid particle tank-ejector connecting tube, and wherein the water supplying means and the mixed fluid discharging means are connected with each other through the water tank-ejector connecting tube.

8. The self cleaning heat exchanger using a solid particle-water supply system according to claim 7, wherein an automatic control valve is provided at an intermediate position on the water tank-solid particle tank connecting tube, and a connecting tube branching from the automatic control valve is adapted to be connected at any one point along the solid particle tank-ejector connecting tube, such that a flow path of water being supplied to the solid particle tank can be controlled.

9. The self cleaning heat exchanger using a solid particle-water supply system according to claim 4 or 5, wherein a hydrocone is further provided at any one point along a connecting tube connecting the mixed fluid nozzle with the ejector, such that some of water in the mixed fluid can be separated and sent back to the mixed fluid tank through a connecting tube, and hence the mixed fluid is supplied to the mixed fluid nozzle at the upper portion of the heat exchanger main body with the volume ratio of the solid particles in the mixed fluid increased.

10. The self cleaning heat exchanger using a solid particle-water supply system according to any one of claims 2, 4, or 5, wherein the separating means comprises a separating plate installed on side of the mixed fluid tank-water tank connecting tube within the mixed fluid tank, and the separating plate is formed with an opening at the lower portion thereof to allow the solid particles to be discharged to the solid particle tank along an inclined surface of the separating plate by gravitational separation.

* * * * *